US006032664A

United States Patent [19]

Gray et al.

[11] Patent Number: 6,032,664

[45] Date of Patent: Mar. 7, 2000

[54] PRESSURE DISPLAY FOR SELF CONTAINED BREATHING APPARATUS

[75] Inventors: Robert E. Gray, Lawrenceville; Paul D. Hiltman, Atlanta; R. David Lewis, Auburn; Victor Speck, Atlanta, all of Ga.

[73] Assignee: International Safety Instruments, Inc., Lawerenceville, Ga.

[21] Appl. No.: 08/652,635

[22] Filed: May 22, 1996

[51] Int. Cl.[7] ..... B63C 11/02

[52] U.S. Cl. ..... 128/201.27; 128/205.23

[58] Field of Search ..... 128/201.27, 201.28, 128/204.26, 205.23; 73/732–734, 741

[56] References Cited

U.S. PATENT DOCUMENTS

| | | | |
|---|---|---|---|
| 2,565,526 | 8/1951 | Seitz | 73/732 |
| 3,301,062 | 1/1967 | Reesby et al. | 73/733 |
| 3,715,927 | 2/1973 | Grant | 73/732 |
| 3,741,015 | 6/1973 | Moss, Jr. et al. | 73/733 |
| 3,820,391 | 6/1974 | Baker, Jr. et al. | 73/733 |
| 3,915,009 | 10/1975 | Worden et al. | 73/733 |
| 4,059,018 | 11/1977 | Reick | 73/732 |
| 4,233,970 | 11/1980 | Kranz | 128/201.28 |
| 4,449,524 | 5/1984 | Gray | 128/204.26 |
| 4,498,471 | 2/1985 | Kranz et al. | 128/204.26 |
| 4,658,358 | 4/1987 | Leach et al. | 128/204.23 |
| 5,033,818 | 7/1991 | Barr | 350/174 |
| 5,097,826 | 3/1992 | Gray et al. | 128/204.18 |
| 5,503,145 | 4/1996 | Clough | 128/201.27 |
| 5,601,078 | 2/1997 | Schaller et al. | 128/205.23 |

*Primary Examiner*—Aaron J. Lewis
*Attorney, Agent, or Firm*—James B. Middleton

[57] ABSTRACT

A self contained breathing apparatus has a display of air pressure within the face mask in the field of vision of the user of the breathing apparatus. The display is four lights that indicate the four quarter-tanks of pressure, and the lights change to indicate the amount of air remaining. A transducer receives tank pressure and provides an electric signal. The air pressure is placed on a bourdon tube which rotates a disk in response to changes in pressure. One half of the disk includes a gradient, and a light source emits light through the gradient to be received by a light sensor. As the disk rotates, the gradient varies the amount of light received by the sensor, so the electrical output of the sensor varies.

8 Claims, 4 Drawing Sheets

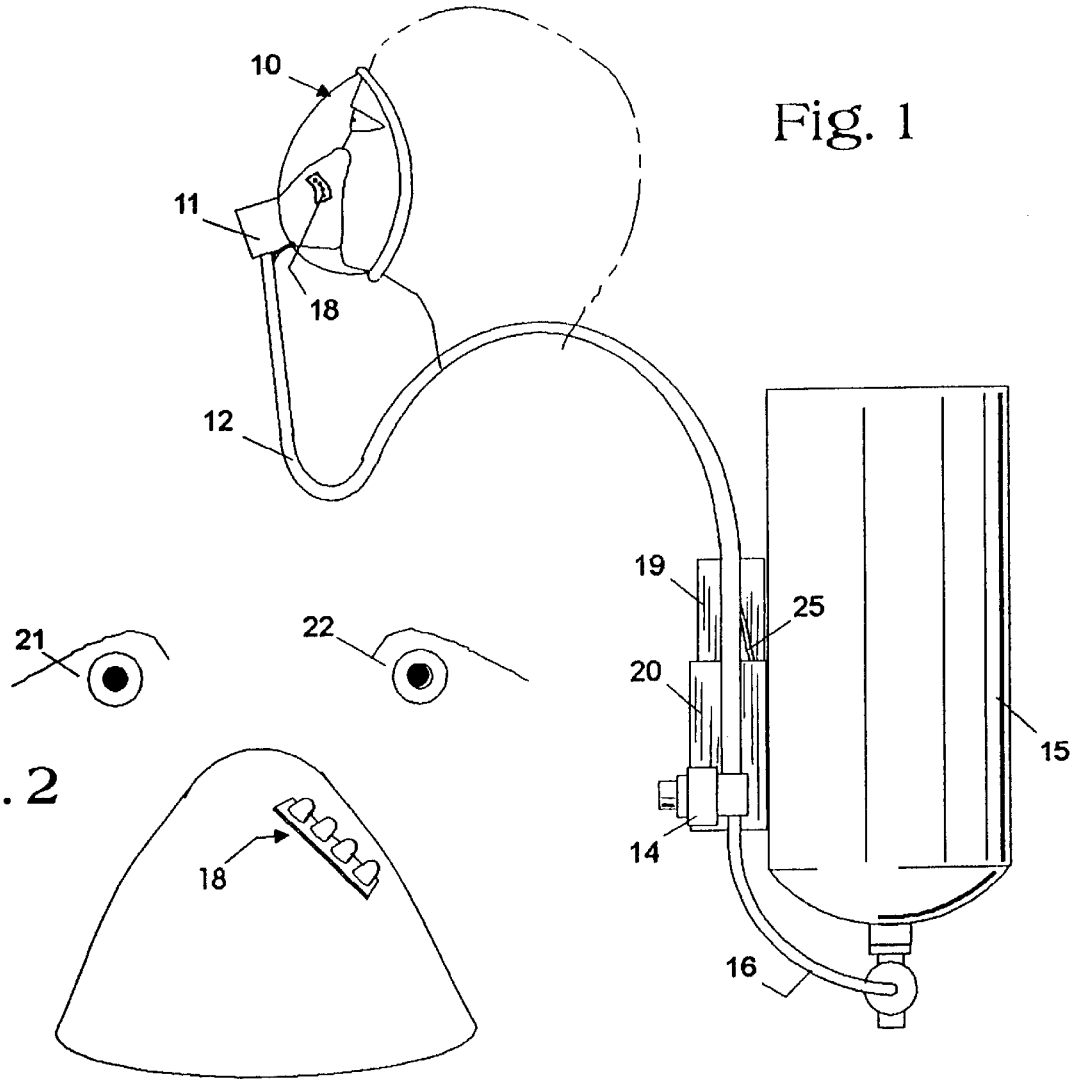
Fig. 1
Fig. 2
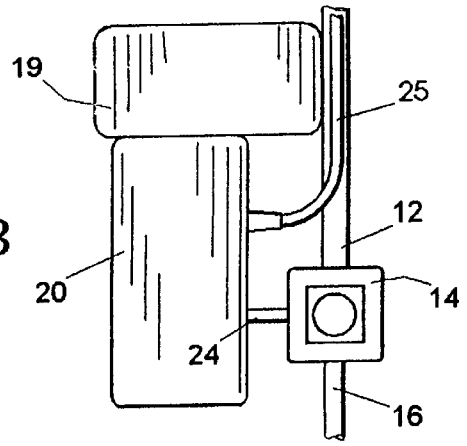
Fig. 3

Fig. 4
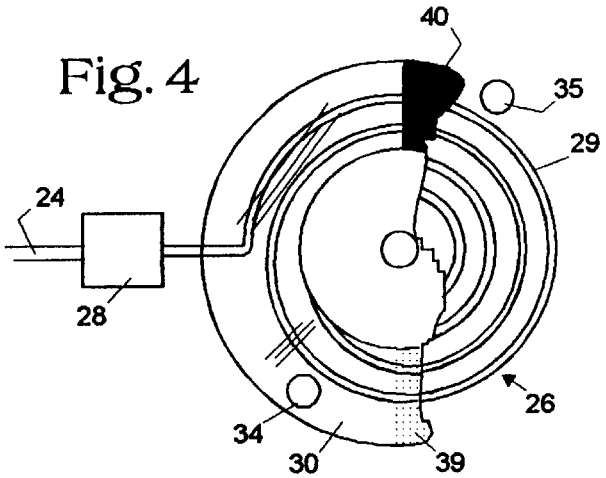
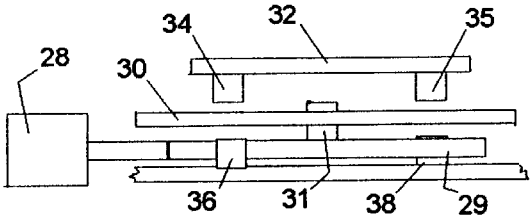
Fig. 5
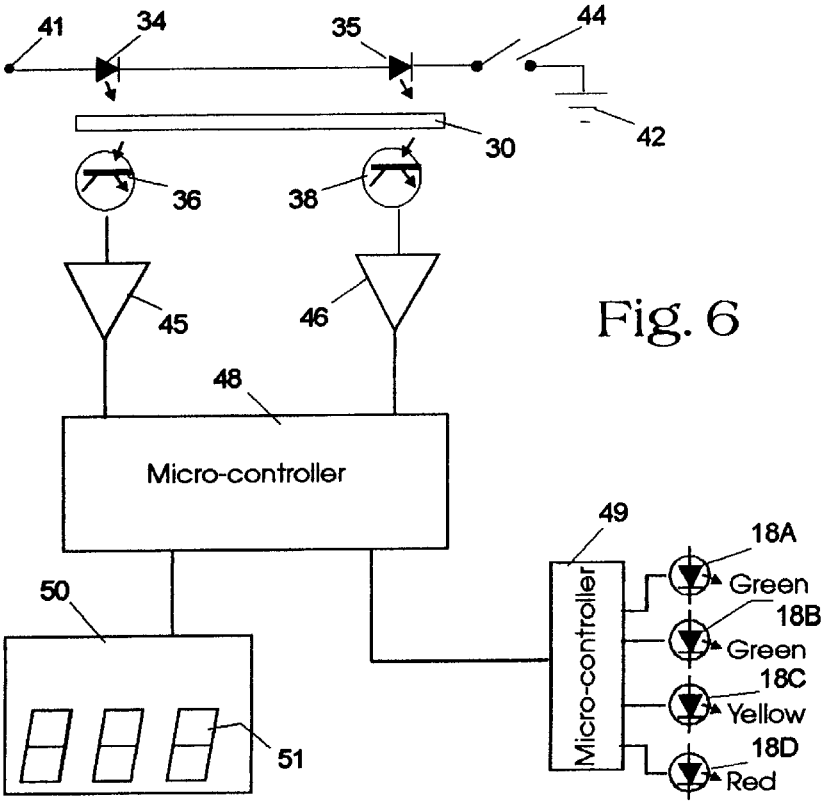
Fig. 6

PRESSURE DISPLAY FOR SELF CONTAINED BREATHING APPARATUS

BACKGROUND OF THE INVENTION

1. Field of the Invention

This invention relates generally to the monitoring of pressure, and is more particularly concerned with pressure monitoring and display means for the air tank of a self contained breathing apparatus.

2. Discussion of the Prior Art

Self contained breathing apparatuses (SCBA) are commonly used in many hazardous environments such as fires and other smoke- or gas-filled environments. A person such as a firefighter uses an SCBA in order to enter the hazardous environment; and, one key to the ability to survive in the environment is to have an adequate supply of air. Though a person will generally enter a hazardous environment with a full tank of air, some means must be available whereby the remaining air can be monitored so the person can leave the hazardous environment before the air supply is depleted.

Conventionally, an SCBA is equipped with a pressure gauge for constantly indicating the pressure remaining in the air tank. The pressure gauge, however, is typically connected to the equipment so that the gauge is exposed to the environment. As a result, when there is, e.g., heavy smoke, the person is unable to see the gauge clearly. There have been efforts at providing a light display so the person using an SCBA constantly has the light display within the field of vision, the light display indicating the pressure remaining in the air tank. The light display, however, has also been exposed to the environment, so it is subject to damage by a hot and/or corrosive environments. It is also subject to poor visibility in an environment of dense smoke or the like.

Thus, the prior art has not provided a reliable, always visible indication of air pressure for an SCBA.

SUMMARY OF THE INVENTION

The present invention provides a plurality of lights disposed within the face mask of a self contained breathing apparatus, and within the field of vision of the person wearing the mask. As the pressure in the air tank is reduced, certain ones of the lights of the plurality of lights will so indicate by changing their appearance. In the preferred embodiment of the invention, there are four lights conforming to the requirement to indicate fourths of a tank of air.

To operate the device of the present invention, a transducer senses the amount of pressure within the air tank and yields an electrical signal to operate the plurality of lights. While many transducers will perform satisfactorily, the present invention provides an inexpensive transducer comprising a bourdon tube carrying a disk that rotates in response to changes in pressure on the bourdon tube. The disk has a varying gray scale; and, energy is propagated through the gray scale and detected by a sensor, so the amount of energy sensed by the sensor is proportional to the amount of air in the tank.

BRIEF DESCRIPTION OF THE DRAWINGS

These and other features and advantages of the present invention will become apparent from consideration of the following specification when taken in conjunction with the accompanying drawings in which:

FIG. 1 is a side elevational view showing a self contained breathing apparatus having a pressure display made in accordance with the present invention, a person's head being shown in phantom;

FIG. 2 is a schematic, front elevational view showing the placement of the lights with respect to the user's eyes;

FIG. 3 is a front elevational view showing the control apparatus for use with the present invention;

FIG. 4 is a top plan view, partially broken away, showing the pressure transducer of the present invention;

FIG. 5 is a front elevation view of the device shown in FIG. 4;

FIG. 6 is a schematic circuit diagram showing the electrical controls for use in the present invention; and, FIGS. 7 and 8 are flow diagrams illustrating the logic used in the circuit of FIG. 6.

DETAILED DESCRIPTION OF THE EMBODIMENT

Figure 7:
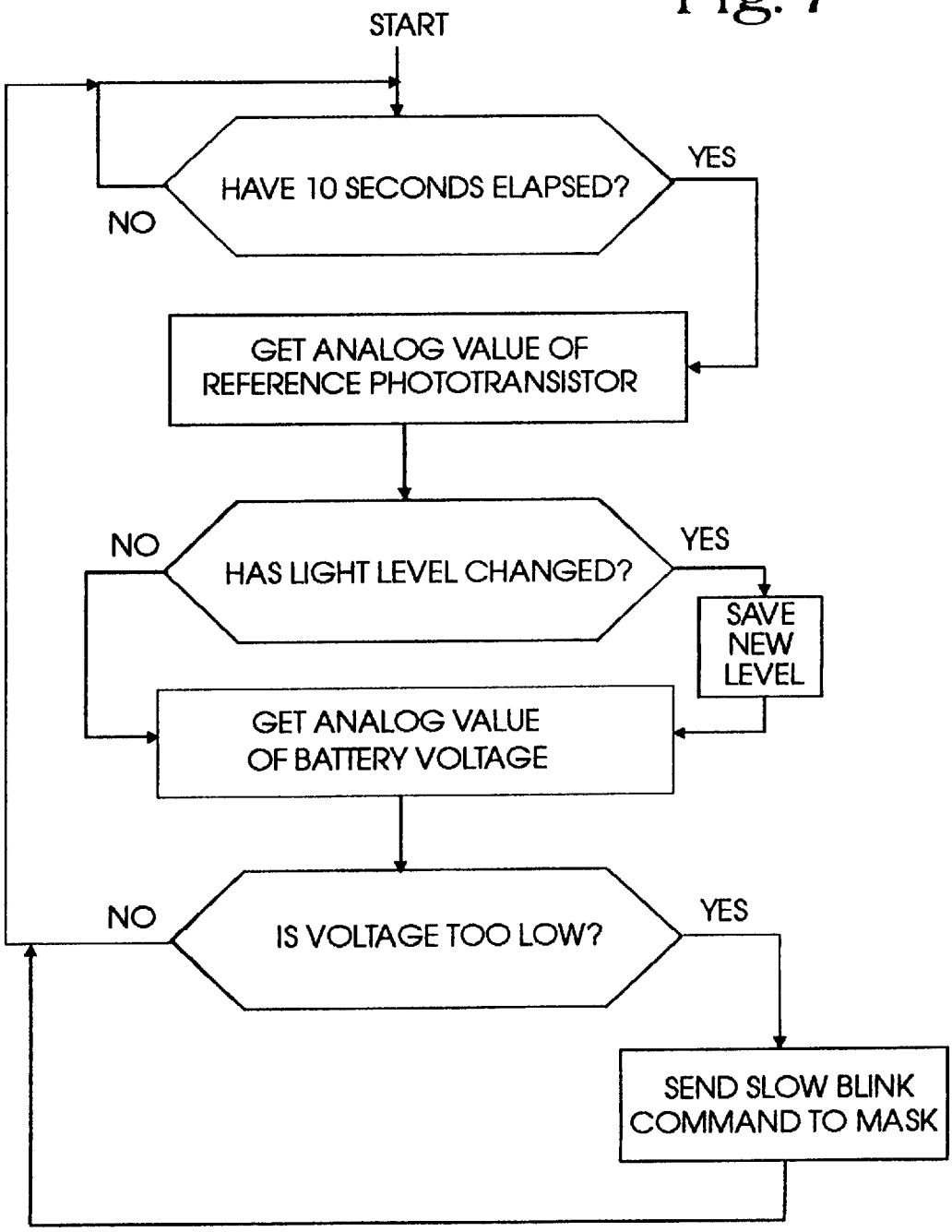

Referring now more particularly to the drawings, and to that embodiment of the invention here presented by way of illustration, FIG. 1 shows a face mask 10 having a pressure regulator 11 thereon, and a hose 12 connecting the regulator 11 to a pressure reducer 14. The pressure reducer 14 is connected to the tank of air 15 by a high pressure hose 16. It will be understood that this constitutes a conventional self contained breathing apparatus (SCBA). The present invention provides a plurality of lights 18 mounted within the face mask 10, the lights being powered and controlled by batteries in a battery pack 19 and control circuitry within the box 20. A cable 25 runs along the hose 12 and enters the face mask 10 to control the lights 18.

Attention is directed to FIG. 2 where the lights 18 can be seen in more detail, and the lights are shown relative to the user's eyes 21 and 22. As here shown, there are four of the lights 18, and the lights are so placed (such as on the nosecup) as to be constantly within the field of vision of the user's left eye 22. Those skilled in the art will understand that the lights 18 could be placed elsewhere, but the position shown is the preferred position.

Mounting of the lights 18 on the nosecup as shown causes the lights to be visible by only one eye. This prevents the user from seeing a double image due to the closeness to both eyes which could be confusing, especially when only one or two lights are illuminated. The object is to allow the user to see the lights at all times, but in the peripheral vision so the lights will not distract the person. Nevertheless, as the pressure in the air tank changes, the light display will change so the person will be aware of the air pressure at all times.

Many different light displays may be used in the present invention, but it is contemplated that there will be four lights 18 corresponding to the four quarters of the air tank. When the tank 15 is completely full, all four of the lights 18 will be lit. AS pressure drops, the highest pressure or fourth, light will start to blink while the other three remain steadily lit, indicating air pressure in the top quadrant (between ¾ and full). As pressure drops below ¾, the highest pressure light will go out and the third light will blink while the other two remain on steadily. A similar change will occur as pressure drops below ½ and ¼. There may be some additional attention-getting device when tank pressure drops to ¼, for example the one, low-pressure, light may blink very rapidly.

Looking now at FIG. 3 of the drawings, the connections of the control box 20 to the SCBA are shown. It will be noticed that a tube 24 connects the regulator 14 to the housing 20, and this tube 24 carries air at tank pressure. Thus, the transducer within the housing receives the full pressure of the tank 15. An electrical cable 25 is connected to the box 20, and runs up the hose 12 to the face mask 10 as was previously described. The battery pack 19 is mounted beside the box 20, and appropriate connections provide electrical power to the box 20.

Within the box 20 there is a transducer which receives air pressure through the tube 24 and converts the pressure to an electrical output. The preferred form of transducer is shown in FIGS. 4 and 5 although those skilled in the art will realize that many forms of transducer will operate quite well with the present invention. The primary reasons the transducer shown is preferred is that the device is very simple and inexpensive to make and to use, yet performs very well.

Attention is directed to FIG. 4 of the drawings which illustrates the transducer generally designated as 26, the transducer 26 being connected to the tube 24 through a support block 28. The transducer 26 includes a bourdon tube 29 which is well known to those skilled in the art. The tube 29 is a spiral, and has an elasticity that tends to retain the spiral shape. When fluid under pressure is admitted to the tube 29 the tube tends to un-wind somewhat, proportionally to the pressure of the fluid. It will be understood that the bourdon tube usually has a pointer, or hand, attached to its innermost portion, so the hand rotates on change of fluid pressure. A dial, then, indicates the pressure applied.

In the present arrangement, the bourdon tube 29 carries a disk 30 so the disk 30 rotates with change in fluid pressure in the tube 29. Looking at both FIG. 4 and FIG. 5 it can be seen that the bourdon tube 29 is carried by the support block 29, and has a shaft 31 attached to its inner end. The disk 30 is mounted on the shaft 31. On one side of the disk 30, there is a circuit board 32 carrying a pair of light sources 34 and 35; and, in FIG. 4 it can be seen that the light source 34 is located so its light passes through a fully transparent portion of the disk 30 while the light source 35 is located so its light passes through a shaded portion of the disk 30.

On the opposite side of the disk 30 from the light sources 34 and 35 there are light receivers 36 and 38. In the preferred form of the invention, the light sources 34 and 35 are light emitting diodes (LED's) that emit light in the infrared range, and the sensors 36 and 38 are phototransistors that are triggered by infrared light. It will be readily understood that other sources and receivers may be used, but these are readily available, and reliable, so they are good choices for the device.

As is indicated in FIG. 4, the disk 30 has a portion that is shaded from substantially fully transparent to substantially opaque. The transparent is indicated at 39 by light stippling, and the opaque is indicated at 40 by the substantially black area. The shading will change gradually through the semi-circular portion of the disk 30 so that, as the disk 30 rotates, the light transmitted to the receiver 38 will change gradually. The electrical signal provided by the sensor 38 will therefore be proportional to the shading of the disk 30. The position of the disk is dependent on the bourdon tube 29, hence on the pressure in the tube 29.

In an effort to assure accurate indications of pressure, one light source and sensor reads a plain, transparent disk 30 while another light source and sensor reads a shaded portion of the disk. Thus, if the voltage is low so that both light sources 34 and 35 emit less light, the pressure reading is not skewed. Similarly, if the disk 30 becomes darkened by age or the like, both sensors 36 and 38 will receive similarly diminished light, and the pressure indications will still be accurate. Thus, the light and sensor 34 and 36 may be referred to as the reference light source and reference sensor, while the light and sensor 35 and 38 may be referred to as sense light source and sense sensor.

A schematic control circuit for the present invention is shown in FIG. 6 of the drawings, where it will be seen that the light sources 34 and 35 are LED's. The two LED's are connected in series, one side of the power being applied at 41. The other side of the LED's is grounded at 42, and the other side of the battery pack will be grounded. There is here shown a switch 44 between the LED 35 and the ground 42. This may be any form of switching means, whether software or hardware, the object being to render the LED's operative or inoperative.

The disk 30 is shown between the LED's 34 and 35 and the sensors, or phototransistors 36 and 38. The outputs of the phototransistors go to amplifiers 45 and 46 which may include analog to digital converters. The signal from the phototransistors 36 and 38 is otherwise conditioned as necessary to provide usable inputs to the micro-controller 48.

An output from the micro-controller 48 is directed to a separate micro-controller 49 which is located in the face mask 10, and acts as the ultimate controller for the lights 18. The individual lights 18 are designated at 18A to 18D. The light 18A is the fourth light indicating a full tank, and the lights 18B, 18C and 18D indicate ¾, ½ and ¼ tank respectively. As indicated in the drawing, the lights 18A and B are green, 18C yellow and 18D red. Other colors may be selected as desired.

Another output from the micro-controller 48 is directed to a digit driver indicated at 50. Since the pressure data is available in digital form in the controller 48, it is very simple to provide a digital display 51 if desired. The digital display 51 may be physically located as desired.

Figure 8:
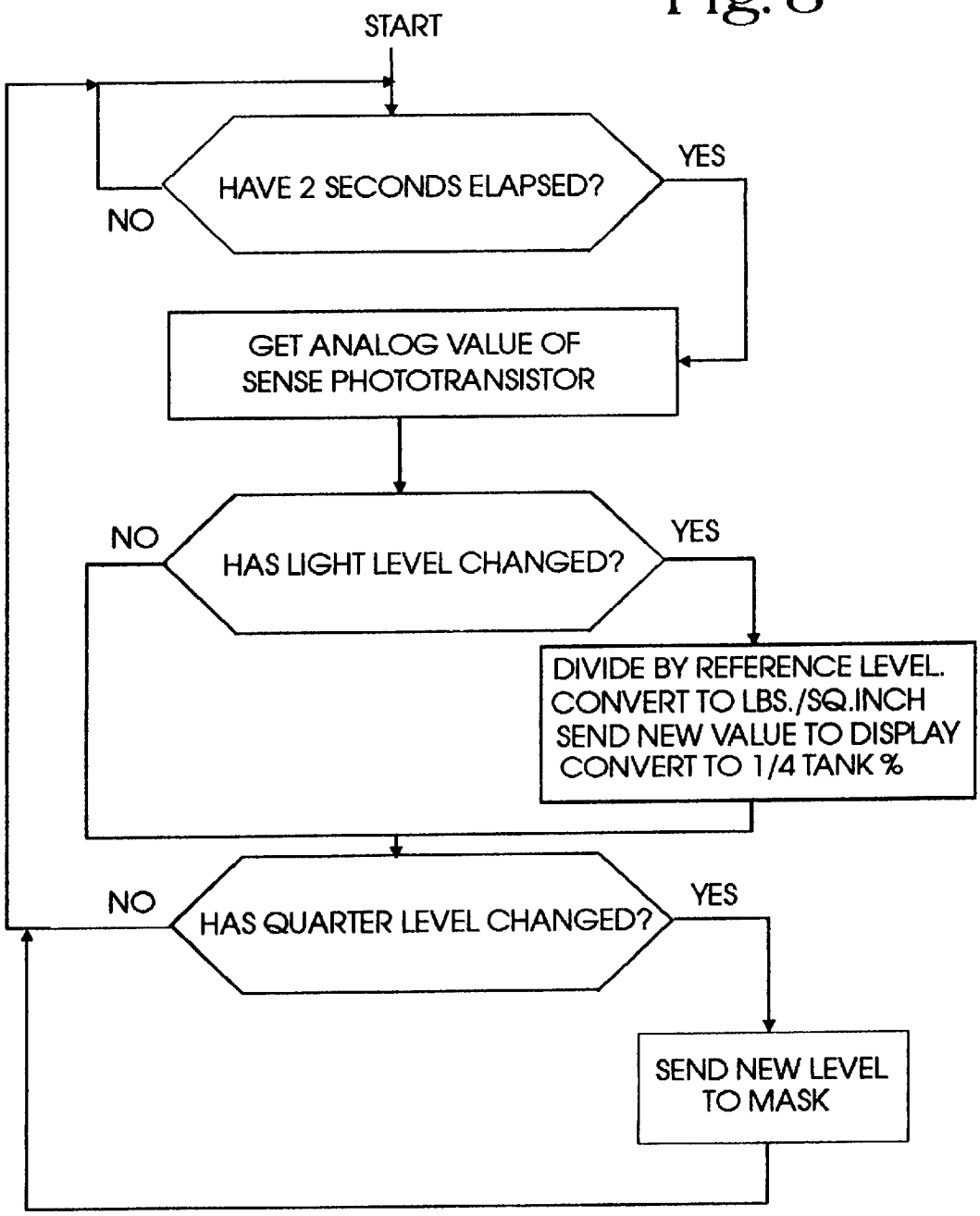

FIG. 7 of the drawings shows the logic for the reference phototransistor 34, and FIG. 8 shows the sense phototransistor. Looking first at FIG. 7, there is a query if 10 seconds have elapsed. Once a "yes" is obtained, the analog value of the reference sensor 36 is obtained. Next, the query is if the light level has changed. If so, the new level is saved, and if not we go directly to get the battery voltage. If the voltage is too low, a "slow-blink" command is sent to the controller 49 in the mask 10; otherwise, the cycle simply repeats, so the same cycle will be repeated each 10 seconds.

For the sense phototransistor 38, the query about elapsed time is 2 seconds. Once 2 seconds have elapsed, the analog value of the sensor 38 is obtained. Next, there is a query if the light level has changed; and, if so, the controller divides the change by the level of the reference phototransistor, converts the number to pounds per square inch, then sends the new value to the display. The value is converted to quarter-tank percentage; then, there is a query if the quarter-level has changed. Since the light display changes only at quarter-tanks, there will be no change in the display unless there is a change in the quarter-level. If there has been such a change, the new level will be sent to the mask; if not, the cycle repeats, and continues to repeat each two seconds.

It should therefore be understood that the pressure in the tank 15 is fed to the transducer 26, and analog signals are provided from the sensors 36 and 38. When the signal indicates a full tank, all the lights 18 will be lit. As the pressure in the tank 15 decreases below full, the decrease will be detected by the transducer 26 and the signal from the sensor 38 will reflect the reduced pressure and the light 18A will begin to blink. After that, so long as the pressure reduction does not amount to a quarter-tank change, there will be no change in the lights 18; but, when a quarter-tank change has been reached, the light 18A will go out, and the light 18B will blink. This process continues until a final quarter-tank remains. Since this is reaching a dangerous level, there is an additional attention getting device, e.g. the light 18D may blink at a very rapid rate to be sure the user is aware that the tank has only one-fourth of its full pressure.

It will therefore be seen that the present invention provides a pressure sensing means and a pressure display means that is safe and easy to use. Since the display is inside the face mask, the display, or its visibility, will not be affected by conditions in which the user is working. This fact protects the display from a hazardous environment such as excess heat or the like, and prevents the display from being obscured by smoke or other fumes. The transducer of the present invention is simple and relatively inexpensive, yet uses well tested apparatus for providing an accurate indication of pressure.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. In the combination of a pressure display with a self contained breathing apparatus, said breathing apparatus comprising an air tank for storing and delivering air under pressure, a face mask to be received over a user's face, hose means connecting said air tank to said face mask, and regulator means for reducing the pressure in said air tank to a breathable pressure within said mask, the improvement wherein said pressure display comprises a plurality of lights mounted within said face mask in the field of view of one eye of a user, a transducer for converting said pressure in said air tank to an electric signal, and control means for varying the lighting of said plurality of lights in accordance with said pressure in said air tank, said control means including a microprocessor within said face mask electrically connected to said plurality of lights.

2. In the combination as claimed in claim 1, the further improvement wherein each light of said plurality of lights represents an equal portion of the maximum pressure in said air tank, and said control means causes said plurality of lights to be extinguished serially as said pressure in said air tank diminishes.

3. In the combination as claimed in claim 2, the improvement wherein said plurality of lights comprises four lights with each light representing a quarter-tank pressure.

4. In the combination of a pressure display with a self contained breathing apparatus, said breathing apparatus comprising an air tank for storing and delivering air under pressure, a face mask to be received over the a user's face, hose means connecting said air tank to said face mask, and regulator means for reducing the pressure in said air tank to a breathable pressure within said face mask, said pressure display containing at least one light, control means for varying said at least one light in accordance with said pressure in said air tank, and a transducer for converting said pressure in said air tank to an electric signal, the improvement wherein said transducer comprises a bourdon tube in communication with said air tank so that said pressure in said air tank is applied to said bourdon tube, a disk carried by said bourdon tube and rotatable thereby on change of pressure applied to said bourdon tube, means for sensing rotation of said disk, and means for providing a varying electric signal in response to rotation of said disk.

5. In the combination as claimed in claim 4, the further improvement wherein said disk includes a gradient thereon for varying light transmission through said disk, a light source on one side of said disk, and a light sensor on the opposite side of said disk located to receive light from said light source, so that the light received by said light sensor varies with rotation of said disk as different portions of said gradient are moved between said light source and said light sensor.

6. In the combination as claimed in claim 5, the improvement wherein said gradient covers less than all of said disk, said transducer further includes a second light source on said one side of said disk and a second light sensor on said opposite side of said disk located to receive light from said second light source, said disk between said second light source and said second light sensor being substantially transparent.

7. In the combination as claimed in claim 6, the further improvement wherein said at least one light comprises a plurality of lights within said face mask.

8. In the combination as claimed in claim 6, the improvement wherein said at least one light comprises a digital display.

* * * * *